US011834286B2

(12) United States Patent
Tokuno et al.

(10) Patent No.: US 11,834,286 B2
(45) Date of Patent: Dec. 5, 2023

(54) PAPER FEEDER, IMAGE FORMING APPARATUS, AND CONTROL METHOD

(71) Applicant: Konica Minolta Inc., Tokyo (JP)

(72) Inventors: Toshiyuki Tokuno, Toyokawa (JP); Masatoshi Hitaka, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 262 days.

(21) Appl. No.: 16/944,213

(22) Filed: Jul. 31, 2020

(65) Prior Publication Data

US 2021/0061593 A1 Mar. 4, 2021

(30) Foreign Application Priority Data

Sep. 4, 2019 (JP) ..... 2019-161193

(51) Int. Cl.

| | |
|---|---|
| ***B65H 3/06*** | (2006.01) |
| ***B65H 1/18*** | (2006.01) |
| ***B65H 7/04*** | (2006.01) |

(52) U.S. Cl.

CPC ..... *B65H 1/18* (2013.01); *B65H 3/0669* (2013.01); *B65H 3/0676* (2013.01); *B65H 7/04* (2013.01); *B65H 2301/531* (2013.01)

(58) Field of Classification Search

CPC ..... B65H 2301/531; B65H 54/702

See application file for complete search history.

(56) References Cited

U.S. PATENT DOCUMENTS 6,877,737 B2 * 4/2005 Yanagi ..... B41J 13/103 271/121

8,777,215 B2 * 7/2014 Ohkura ..... B65H 3/66 271/157

FOREIGN PATENT DOCUMENTS

| | | | |
|---|---|---|---|
| JP | H0597262 | A | 4/1993 |
| JP | 8-67372 | A | 3/1996 |
| JP | 2000327152 | A | 11/2000 |
| JP | 2007063003 | A | 3/2007 |
| JP | 2007-119189 | A | 5/2007 |
| JP | 2018131282 | A * | 8/2018 |

OTHER PUBLICATIONS

Japanese Office Action (JPOA) dated Apr. 25, 2023 issued in Japanese patent application No. 2019-161193 and its English machine translation.

* cited by examiner

*Primary Examiner* — Howard J Sanders

(74) *Attorney, Agent, or Firm* — Rankin, Hill & Clark LLP

(57) ABSTRACT

A paper feeder, includes: a sheet storage that stores sheets; a pick roller that delivers the sheets stored in the sheet storage to a downstream side of a conveyance path; a pair of conveyance rollers that is located on a downstream side of the pick roller in the conveyance path and conveys the sheets delivered from the pick roller to further downstream side in the conveyance path; a drive source that drives the pair of conveyance rollers; and a hardware processor that cleans the pair of conveyance rollers by driving the drive source to rotate the pair of conveyance rollers in a state of being in contact with each other, when the pick roller cannot deliver sheets.

17 Claims, 12 Drawing Sheets

FIG. 9

53

| NUMBER OF SHEETS REQUIRED FOR CLEANING | CLEANING TIME |
|---|---|
| 1000 SHEETS | 8 SECONDS |
| 1500 SHEETS | 8 SECONDS |
| 2000 SHEETS | 7 SECONDS |
| 2500 SHEETS | 7 SECONDS |
| 3000 SHEETS | 6 SECONDS |
| 3500 SHEETS | 6 SECONDS |
| 4000 SHEETS | 5 SECONDS |
| 4500 SHEETS | 4 SECONDS |

PAPER FEEDER, IMAGE FORMING APPARATUS, AND CONTROL METHOD

The entire disclosure of Japanese patent Application No. 2019-161193, filed on Sep. 4, 2019, is incorporated herein by reference in its entirety.

BACKGROUND

Technological Field

The present invention relates to a paper feeder, an image forming apparatus, and a control method.

Description of the Related Art

An image forming apparatus for forming and outputting an image on a sheet such as printing paper has a conveyance path for conveying sheets inside the apparatus, and is provided with a paper feed roller for feeding sheets one by one to the conveying path. The paper feed roller reduces the conveying force every time a sheet is fed. If the conveying force of the paper feed roller falls below a certain limit, a jam is likely to occur when a sheet is fed in the image forming apparatus.

Adhesion of paper dust on a sheet is one of the factors that reduce the conveying force of the paper feed roller. If excessive paper dust adheres to a surface of the paper feed roller, the frictional force between the paper feed roller and a sheet is reduced, and the conveying force of the paper feed roller is reduced. In order to suppress the decrease in the conveying force due to paper dust, it is necessary to perform cleaning for removing the paper dust adhering to the surface of the paper feed roller.

Conventionally, some methods are proposed for cleaning the paper feed roller. For example, in the first conventional technique disclosed in JP 8-67372 A, in conjunction with the operation of pulling out a paper feed cassette, a dedicated cleaning member for removing paper dust is pressed against a paper feed roller, and in that state, the paper feed roller is rotated for a certain period of time to remove paper dust adhering to a surface. Further, for example, in the second conventional technique disclosed in JP 2007-119189 A, information about a sheet is acquired, and the paper feed roller is cleaned after printing is completed based on the information and the number of fed sheets.

When a dedicated cleaning member is attached, as in the first conventional technique described above, it is necessary to provide a space for mounting the cleaning member inside the apparatus, and therefore there are problems that the size of the apparatus increases, and the cost of the apparatus increases.

Further, in the second conventional technique, the type of the sheet to be fed is determined based on the information regarding the sheet, and whether or not to perform cleaning is determined. That is, when a sheet to be fed is a sheet in which paper dust is hard to be generated, it prevents a paper feed roller from wearing out by not performing cleaning. However, in order to determine whether or not the sheet is likely to generate paper dust, it is necessary for a user to correctly input information regarding a sheet. If a user inputs an incorrect sheet type, the cleaning will not be executed even if the sheet is likely to generate paper dust, and there is a problem that a jam frequently occurs since the conveying force of the paper feed roller reduces.

SUMMARY

The present invention has been made to solve the above conventional problems, and an object of the present invention is to provide a paper feeder, an image forming apparatus, and a control method, that can properly clean a paper feed roller without increasing the size of the apparatus or increasing the cost.

To achieve the abovementioned object, according to an aspect of the present invention, a paper feeder reflecting one aspect of the present invention comprises: a sheet storage that stores sheets; a pick roller that delivers the sheets stored in the sheet storage to a downstream side of a conveyance path; a pair of conveyance rollers that is located on a downstream side of the pick roller in the conveyance path and conveys the sheets delivered from the pick roller to further downstream side in the conveyance path; a drive source that drives the pair of conveyance rollers; and a hardware processor that cleans the pair of conveyance rollers by driving the drive source to rotate the pair of conveyance rollers in a state of being in contact with each other, when the pick roller cannot deliver sheets.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 9 is a diagram illustrating an example of cleaning information;

DETAILED DESCRIPTION OF EMBODIMENTS

Figure 1:
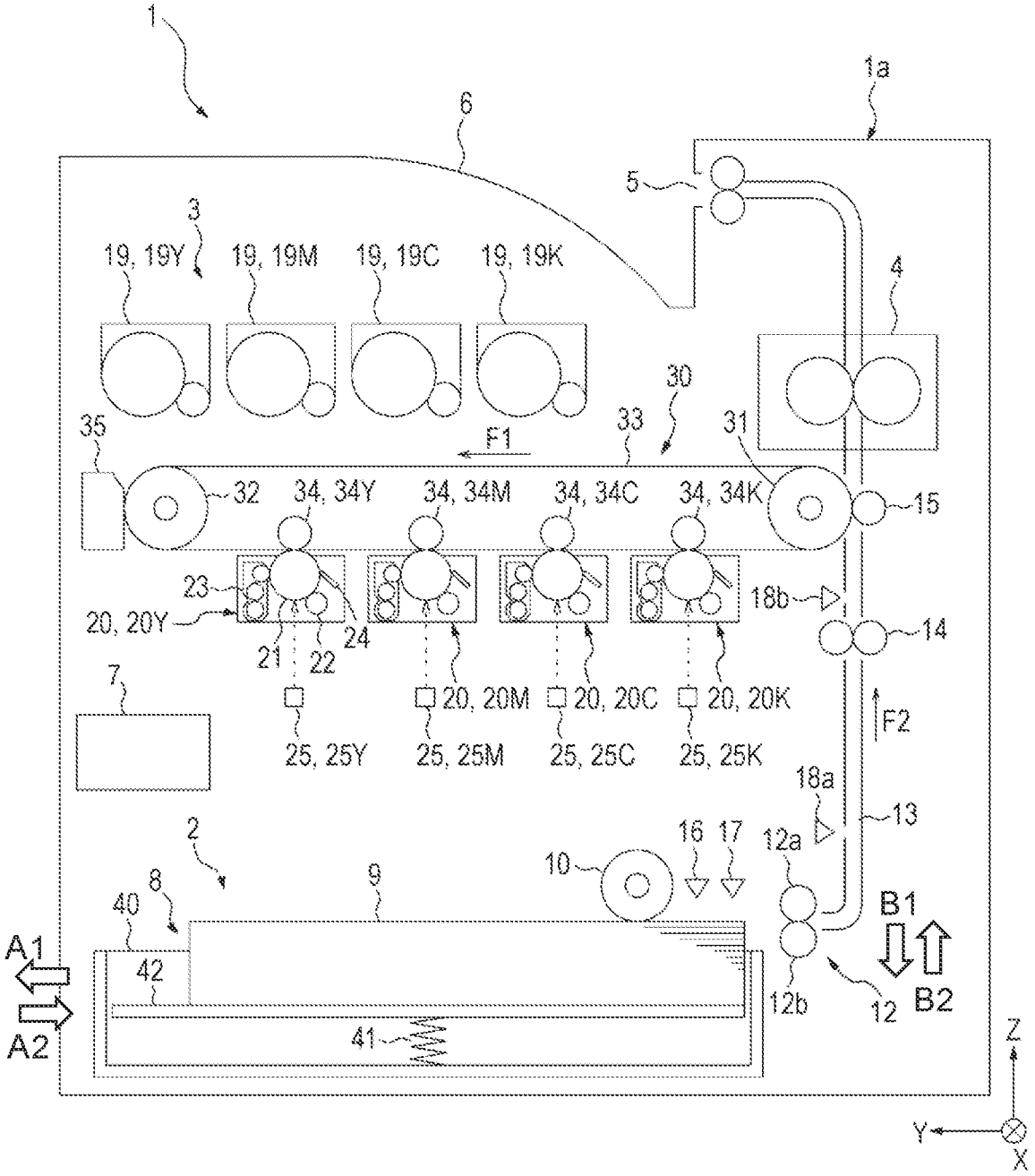
FIG. 1 is a conceptual diagram illustrating a configuration example of an image forming apparatus.

Hereinafter, one or more embodiments of the present invention will be described with reference to the drawings. However, the scope of the invention is not limited to the disclosed embodiments. It should be noted that, in the embodiments described below, elements common to each other are denoted by the same reference numerals, and duplicate description thereof will be omitted.

First Embodiment

FIG. 1 is a conceptual diagram illustrating a configuration example of an image forming apparatus 1 which is an embodiment of the present invention. The image forming apparatus 1 is a printer that forms an image on a sheet 9 such as printing paper by an electrophotographic method and outputs the image, and is an apparatus that can form a color image by a tandem method. The image forming apparatus 1 includes a paper feeder 2, an image forming unit 3, and a fixing unit 4, inside an apparatus main body 1*a*. The image forming apparatus 1 conveys the sheets 9 one by one, forms a color image or a monochrome image on the sheets 9, and discharges the sheets 9 from an upper discharge port 5 onto the discharge tray 6. Further, the image forming apparatus 1 includes a controller 7 inside the apparatus main body 1*a*. The controller 7 controls operations of each unit such as the paper feeder 2, the image forming unit 3, and the fixing unit 4. Further, as will be described later, the controller 7 controls a cleaning operation of a pair of conveyance rollers 12 provided in the paper feeder 2, more specifically, the paper feed roller 12*a*.

The paper feeder 2 has a paper feed cassette 8 that can be attached to and detached from the apparatus main body 1*a*, and the sheet 9 can be stored in the paper feed cassette 8. The paper feed cassette 8 includes a sheet storage 40 for storing the sheet 9, a holding member 42 provided at the bottom of the sheet storage 40 for holding the sheet 9 stored in the sheet storage 40, and a lift drive unit 41 for moving the holding member 42 up and down.

Figure 2:
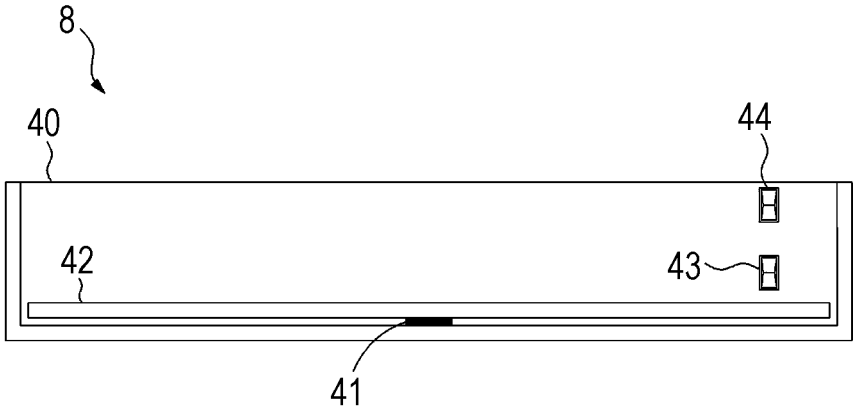
FIG. 2 is a view illustrating a configuration of a paper feed cassette.

FIG. 2 is a view illustrating the configuration of the paper feed cassette 8 with the sheet 9 removed. FIG. 2 illustrates a state in which the holding member 42 is lowered to a sheet replenishment position, which is the initial position, by the lift drive unit 41. The paper feed cassette 8 has a plurality of remaining amount detection sensors 43 and 44 for detecting the remaining amount of the sheets 9 on the peripheral wall of the sheet storage 40. A plurality of the remaining amount detection sensors 43 and 44 is provided at different height positions on the peripheral wall of the sheet storage 40. When the sheet 9 is replenished while the holding member 42 is at the sheet replenishment position, the remaining amount detection sensors 43 and 44 contact the side surfaces of a bundle of the sheets 9 and are turned on by pressing force received from a bundle of the sheets 9. Therefore, depending on the ON state of each of a plurality of the remaining amount detection sensors 43 and 44, the remaining amount of the sheets 9 held by the holding member 42 can be detected. Such remaining amount detection sensors 43 and 44 are one of detectors for detecting the sheet 9 stored in the sheet storage 40. Note that the remaining amount detection sensors 43 and 44 are not limited to contact-type sensors, and a non-contact-type sensor may be adopted.

Returning to FIG. 1, the paper feeder 2 takes out the uppermost one sheet 9 of the sheets 9 stored in the paper feed cassette 8 and feeds the sheet 9 to a conveyance path 13 formed inside the apparatus. When the sheets 9 stored in the paper feed cassette 8 run out, a user can replenish the sheet 9 by pulling out the paper feed cassette 8 from the apparatus main body 1*a*. After replenishing the sheets 9, a user can insert the paper feed cassette 8 into the paper feeder 2 by pushing the paper feed cassette 8 into a predetermined position inside the apparatus main body 1*a*.

Further, the paper feeder 2 includes a pick roller 10, the pair of conveyance rollers 12, and a conveyance roller 14 as a mechanism for conveying the sheet 9. The pair of conveyance rollers 12 includes a paper feed roller 12*a* and a separation roller 12*b* that are arranged with the conveyance path 13 interposed therebetween.

The pick roller 10 is a roller also referred to as a pickup roller, and at least uppermost one sheet 9 of the sheets 9 stored in the paper feed cassette 8 is delivered toward the downstream side of the conveyance path 13.

The pick roller 10 is rotationally driven in a predetermined direction by a drive source such as a motor, and the sheet 9 pressed against the lower portion of the roller is delivered to the downstream side of the conveyance path 13 by frictional force. When the uppermost first sheet 9 is delivered by the pick roller 10, multiple sheets 9, such as the second and third sheets, may be delivered at the same time.

The pair of conveyance rollers 12 is arranged on the downstream side of the pick roller 10, and feeds the uppermost one sheet 9 among at least one sheet 9 delivered from the pick roller 10 to the downstream side of the conveyance path 13. That is, the pair of conveyance rollers 12 has a function that, when the multiple sheets 9 are delivered simultaneously by the pick roller 10, the paper feed roller 12*a* and the separation roller 12*b* cooperate to separate only the uppermost one sheet 9 from the multiple sheets 9 and deliver it to the downstream side.

The paper feed roller 12*a* is provided on the downstream side of the pick roller 10 in the conveyance path 13, and feeds the sheet 9 delivered from the pick roller 10 to a further downstream side of the conveyance path 13.

The paper feed roller 12*a* is rotationally driven in a predetermined rotational direction by the same drive source as the pick roller 10. The paper feed roller 12*a* also feeds the sheet 9 to the downstream side of the conveyance path 13 by frictional force with the sheet 9. Therefore, the paper feed roller 12*a* has an outer peripheral surface formed of an elastic member having a high friction coefficient, such as rubber, and is subjected to emboss processing in which many recessed portions are provided on a surface of the elastic member. The frictional force can be increased by subjecting the surface of the paper feed roller 12*a* to the emboss processing The separation roller 12*b* is a roller that is arranged so as to face the paper feed roller 12*a* with the conveyance path 13 interposed therebetween, and is a roller that forms a pair with the paper feed roller 12*a*. The separation roller 12*b* is rotatable around a predetermined rotation axis, and a torque limiter is provided on the rotation axis. The separation roller 12*b* is arranged such that the outer peripheral surface thereof contacts the outer peripheral surface of the paper feed roller 12*a*, and when the paper feed roller 12*a* rotates, and the torque acting on the separation roller 12*b* exceeds a predetermined torque, the separation roller 12*b* is driven to rotate by the rotation of the paper feed roller 12*a*. The separation roller 12*b* stops the progress of the second and subsequent sheets 9 when multiple sheets 9 are delivered by the pick roller 10, such that only the first sheet 9 at the top can pass through a nip between the paper feed roller 12*a*. That is, the separation roller 12*b* is a roller for separating the first sheet 9 from the second and subsequent sheets 9 and feeding only the first sheet 9 to the downstream side.

The rotation axis of the separation roller 12*b* is formed so as to be movable toward the paper feed roller 12*a* when the paper feed cassette 8 is attached and detached. For example, when the paper feed cassette 8 is pulled out from the apparatus main body 1*a* (arrow A1), the separation roller 12*b* is separated from the paper feed roller 12*a* (arrow B1), and the surface of the separation roller 12*b* and the surface of the paper feed roller 12*a* are not in contact with each other. For that reason, if a jam occurs while feeding the sheets 9, by pulling out the paper feed cassette 8 from the apparatus main body 1*a*, the sheet 9 sandwiched between the paper feed roller 12*a* and the separation roller 12*b* can be easily removed. When the paper feed cassette 8 is attached to the apparatus main body 1*a* (arrow A2), the separation roller 12*b* approaches the paper feed roller 12*a* (arrow B2), and the surface of the separation roller 12*b* comes into contact with the surface of the paper feed roller 12*a*.

The conveyance roller 14 is formed of a pair of rollers, the sheet 9 fed to the downstream side of the conveyance path 13 by the paper feed roller 12*a* is further conveyed to the downstream side. For example, the conveyance roller 14 is rotationally driven in a predetermined rotation direction by a drive source different from the drive source that drives the pick roller 10 and the paper feed roller 12*a*.

Further, the paper feeder 2 includes an upper limit detection sensor 16 and an empty sensor 17 on the upper portion of the paper feed cassette 8. The upper limit detection sensor 16 is a sensor that detects whether or not the sheet 9 stored in the paper feed cassette 8 is at a predetermined upper limit position with respect to the pick roller 10. For example, the upper limit detection sensor 16 detects that the sheet 9 stored in the paper feed cassette 8 and in contact with the lower portion of the uppermost pick roller 10 is located at a predetermined upper limit position. On the other hand, when the uppermost sheet 9 is not in contact with the pick roller 10, the upper limit detection sensor 16 detects that the sheet 9 is not at the predetermined upper limit position. Further, the empty sensor 17 is a sensor that detects an empty state of the sheet 9 stored in the paper feed cassette 8. Both the upper limit detection sensor 16 and the empty sensor 17 are one of detectors for detecting the sheet 9 stored in the sheet storage 40.

Further, the paper feeder 2 includes the sheet detection sensors 18*a* and 18*b* for detecting passage of the sheet 9 on the conveyance path 13 at two positions that are a predetermined position on the downstream side of the paper feed roller 12*a* and a predetermined position on the downstream side of the conveyance roller 14. Each of these sheet detection sensors 18*a* and 18*b* is a paper feed detector that detects the sheet 9 fed by the paper feed roller 12*a*.

The image forming unit 3 forms four color toner images of Y (yellow), M (magenta), C (cyan), and K (black), and when the sheet 9 fed by the paper feeder 2 passes through the position of a secondary transfer roller 15, the image forming unit 3 can simultaneously transfer the four color toner images to the sheet 9. The image forming unit 3 includes multiple toner bottles 19 (19Y, 19M, 19C, and 19K) corresponding to each color, a plurality of image forming units 20 (20Y, 20M, 20C, and 20K) corresponding to each color, a plurality of exposure units 25 (25Y, 25M, 25C, and 25K) corresponding to each color, and a transfer unit 30.

The transfer unit 30 includes a pair of rollers 31 and 32 arranged at a predetermined interval, an intermediate transfer belt 33 formed of an endless belt and arranged in a state of being hung on the pair of rollers 31 and 32, a plurality of primary transfer rollers 34 (34Y, 34M, 34C, and 34K) arranged at a position facing each image forming unit 20 inside the intermediate transfer belt 33, and a cleaning unit 35 for removing toner remaining on the surface of the intermediate transfer belt 33, and the transfer unit 30 is a unit in which these are integrally assembled.

Of the pair of rollers 31 and 32, one roller 31 is a drive roller that rotates by being mounted on a drive shaft provided inside the apparatus main body 1*a*, and the intermediate transfer belt 33 is circularly moved in the direction of arrow F1 by rotationally driving the drive shaft. The other roller 32 is mounted to a driven shaft provided inside the apparatus main body 1*a*, and is driven to rotate as the intermediate transfer belt 33 circulates. The pair of rollers 31 and 32 are arranged at positions separated by a predetermined distance inside the apparatus main body 1*a* in a state where a constant tension is applied to the intermediate transfer belt 33. The roller 31 is arranged at a position facing the secondary transfer roller 15 by being mounted on the drive shaft, and the roller 31 applies a pressing force to the intermediate transfer belt 33 while sandwiching the intermediate transfer belt 33 between the roller 31 and the secondary transfer roller 15. Then, the roller 31 secondarily transfers a toner image formed on the surface of the intermediate transfer belt 33 to the sheet 9, by sandwiching and pressing the sheet 9 conveyed from the paper feeder 2 between the intermediate transfer belt 33 and the secondary transfer roller 15.

The cleaning unit 35 is held in contact with the surface of the intermediate transfer belt 33 at a position facing the roller 32, and removes toner remaining on the surface of the intermediate transfer belt 33 that circulates in the direction of arrow F1.

The image forming units 20Y, 20M, 20C, and 20K corresponding to each color is provided below the transfer unit 30, and the exposure units 25Y, 25M, 25C, and 25K corresponding to each color are provided below the image forming units 20Y, 20M, 20C, and 20K. The toner bottles 19Y, 19M, 19C, and 19K are arranged above the transfer unit 30 and supply a developer containing toners of each color to the image forming units 20Y, 20M, 20C, and 20K.

The image forming units 20Y, 20M, 20C, and 20K have the same configuration, and only the colors of toners used are different. That is, each image forming unit 20Y, 20M, 20C, and 20K includes an image carrier 21 configured as a photoconductor drum, a charging unit 22 arranged around the image carrier 21, a developing device 23, and a cleaning blade 24. Note that, in the following, when it is not necessary to distinguish the image forming units 20Y, 20M, 20C, and 20K, they may be collectively referred to as the image forming unit 20.

The image carrier 21 has a photosensitive layer on a drum surface. For example, it rotates in the clockwise direction while being in contact with the intermediate transfer belt 33 to which the transfer pressure of the primary transfer roller 34 of the transfer unit 30 is applied. The cleaning blade 24, the charging unit 22, and the developing device 23 are arranged around the image carrier 21 along the rotation direction. The charging unit 22 includes a charging roller that is in contact with the surface of the image carrier 21, and charges the surface of the image carrier 21 to a predetermined charge. The exposure unit 25 forms an electrostatic latent image on the surface of the image carrier 21 by exposing a photosensitive layer charged by the charging unit 22 based on image data. The developing device 23 is filled with a developer containing a toner and a carrier, supplies the developer to the surface of the image carrier 21, and forms a toner image on the surface of the image carrier 21 by visualizing an electrostatic latent image with the toner. The toner image formed on the image carrier 21 is primarily transferred to the intermediate transfer belt 33 at a position where the toner image is in contact with the intermediate transfer belt 33. A bias voltage having a polarity opposite to that of the charged toner image formed on the surface of the image carrier 21 is applied to the primary transfer roller 34, and the toner image formed on the surface of the image carrier 21 to the intermediate transfer belt 33 by electrostatic force can be primarily transferred.

While cooperating with the respective primary transfer rollers 34Y, 34M, 34C, and 34K, the image forming units 20Y, 20M, 20C, and 20K perform the primary transfer while sequentially superimposing toner images of the respective colors on the intermediate transfer belt 33 that cyclically moves in the direction of arrow F1. Therefore, when the intermediate transfer belt 33 passes the position of the most downstream image forming unit 20K, on the surface of the intermediate transfer belt 33, a color image in which toner images of four colors are superimposed is formed. In addition, when forming a monochrome image on the sheet 9, the image forming units 20Y, 20M, and 20C do not operate, and only the image forming unit 20K corresponding to K (black) operates to form a monochrome image on the intermediate transfer belt 33 using only K toner.

Then, when the toner image formed on the intermediate transfer belt 33 passes through the position facing the secondary transfer roller 15, it contacts the sheet 9 fed by the paper feeder 2 and is secondarily transferred to the surface of the sheet 9. That is, the secondary transfer roller 15 is provided at a position facing the roller 31 with the intermediate transfer belt 33 interposed therebetween, and when a toner image primarily transferred to the intermediate transfer belt 33 comes into contact with the sheet 9, the secondary transfer roller 15 secondarily transfers the toner image onto the sheet 9 by applying a bias voltage having a polarity opposite to that of the charged toner.

The sheet 9 onto which the toner image has been transferred at the position of the secondary transfer roller 15 is then conveyed to the fixing unit 4. The fixing unit 4 fixes the toner image on the sheet 9 by applying a pressure process and a heat process to the sheet 9 onto which the toner image is transferred. The sheet 9 on which the toner image has been fixed in the fixing unit 4 is then discharged onto the discharge tray 6 from the discharge port 5 located at the upper part of the apparatus main body 1*a*.

Figure 3:
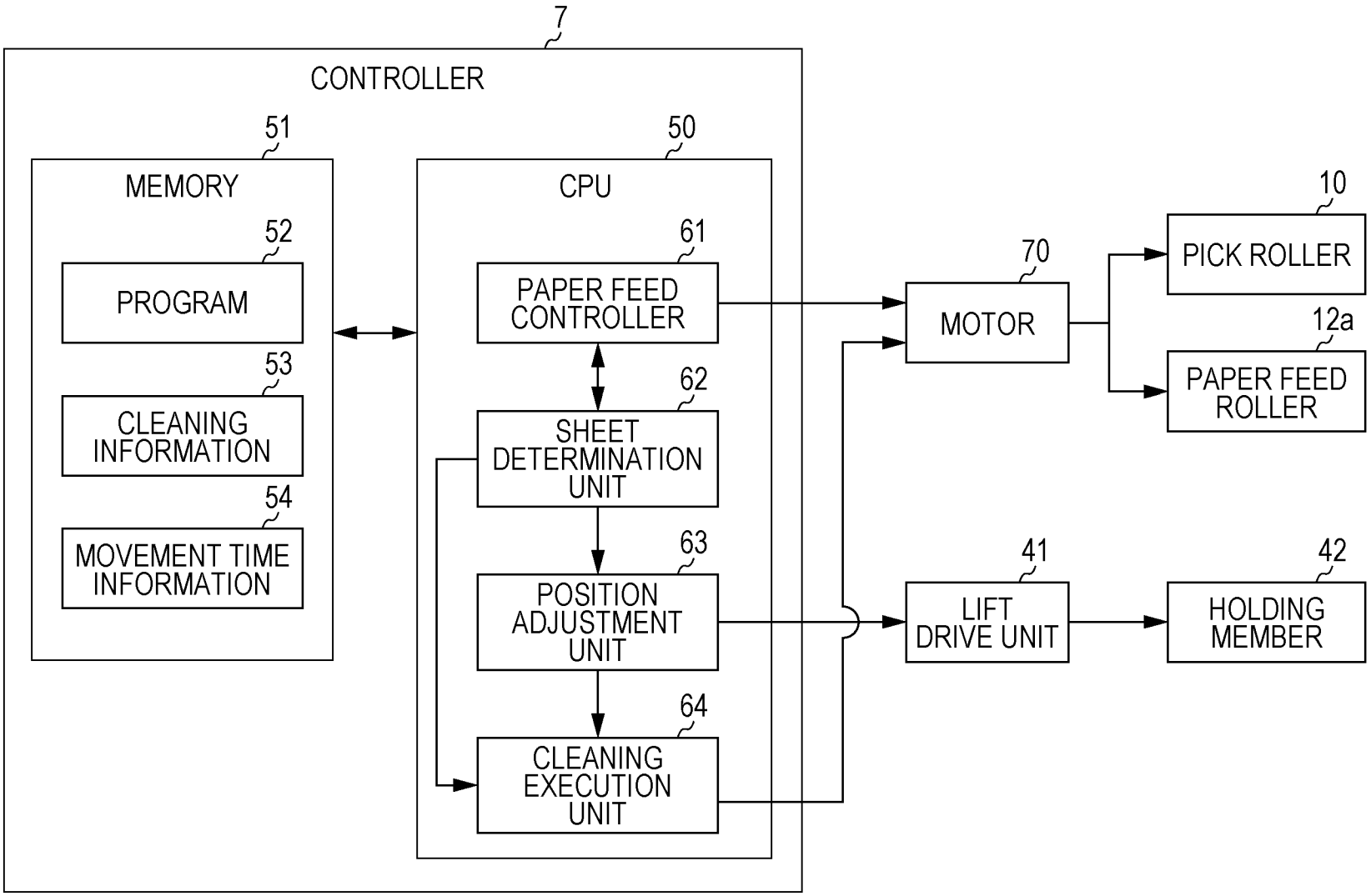
FIG. 3 is a block diagram illustrating a configuration example of a controller.

Next, the controller 7 will be described. FIG. 3 is a block diagram illustrating a configuration example of the controller 7. The controller 7 integratedly controls the operation of forming an image on the sheet 9 and performing print output in the image forming apparatus 1. That is, the controller 7 controls the operation of forming a toner image on each sheet 9 fed from the paper feeder 2, fixing the toner image on the sheet 9, and outputting the image, by operating the paper feeder 2, the image forming unit 3, and the fixing unit 4 in synchronization.

The controller 7 includes, for example, a CPU 50 and a memory 51. The CPU 50 is an arithmetic processor that executes various programs. The memory 51 is a non-volatile storage unit that stores various information. A program 52 executed by the CPU 50 is stored in the memory 51. The program 52 is a program for performing print output by synchronizing the paper feeder 2, the image forming unit 3, and the fixing unit 4. Therefore, the program 52 includes a program for controlling the paper feed operation of the paper feeder 2. Further, the program 52 also includes a program for controlling the cleaning operation of the paper feed roller 12*a* provided in the paper feeder 2. Further, the memory 51 stores cleaning information 53 and movement time information 54 that are referred to when controlling the cleaning operation of the paper feed roller 12*a*, in advance. Note that, in the following, the operation of the CPU 50 controlling the paper feeder 2 will be described in detail.

The CPU 50 functions as various processors by reading the program 52 from the memory 51 and executing it. FIG. 3 exemplifies a function for controlling the paper feeder 2. As illustrated in FIG. 3, by executing the program 52, the CPU 50 functions as a paper feed controller 61, a sheet determination unit 62, a position adjustment unit 63, and a cleaning execution unit 64.

The paper feed controller 61 controls the paper feed operation of the sheets 9 stored in the paper feed cassette 8. Specifically, the paper feed controller 61 rotates each of the pick roller 10 and the paper feed roller 12*a* in a predetermined rotation direction by driving a motor 70 provided as a common drive source for the pick roller 10 and the paper feed roller 12*a*, and feeds one sheet 9 located at the uppermost part to the downstream side of the conveyance path 13 among the sheets 9 stored in the paper feed cassette 8. By this paper feed operation, the number of sheets 9 stored in the paper feed cassette 8 decreases one by one.

The sheet determination unit 62 is a processor that determines a state of the sheets 9 stored in the sheet storage 40. For example, the sheet determination unit 62 determines whether or not the sheet 9 can be delivered by the pick roller 10. The sheet 9 stored in the sheet storage 40 of the paper feed cassette 8 is held by the holding member 42. The holding member 42 is movable up and down with respect to the pick roller 10 by being driven up and down by the lift drive unit 41. When the holding member 42 rises, the sheet held by the holding member 42 comes into contact with the lower portion of the pick roller 10, and the pick roller 10 is ready to be delivered to the conveyance path 13. That is, the sheet determination unit 62 detects a state in which the lower portion of the pick roller 10 and the sheet 9 stored in the sheet storage 40 are in contact with each other and determines that the sheet 9 can be delivered by the pick roller 10. Conversely, when the sheet 9 is not in contact with the lower portion of the pick roller 10, the sheet determination unit 62 determines that the pick roller 10 cannot deliver the sheet 9.

The sheet determination unit 62 monitors the outputs of the upper limit detection sensor 16 and the empty sensor 17, and determines whether or not the sheet 9 can be delivered by the pick roller 10 based on the state of the sheet 9 detected by the sensors 16 and 17. For example, when the upper limit detection sensor 16 detects that the uppermost sheet 9 of the sheets 9 stored in the paper feed cassette 8 is not at a predetermined upper limit position, the sheet determination unit 62 determines based on the detection result that the pick roller 10 cannot deliver the sheet 9. Further, when the empty sensor 17 detects the empty state of the sheet 9 in the paper feed cassette 8, the sheet determination unit 62 determines based on the detection result that the pick roller 10 cannot deliver the sheet 9.

The sheet determination unit 62 makes the above determination each time the paper feeding operation is performed by the paper feed controller 61. Then, the sheet determination unit 62 outputs the determination result of the sheet state to the paper feed controller 61 and the position adjustment unit 63.

For example, when continuously feeding a plurality of sheets 9 during execution of a print job, the paper feed controller 61 temporarily stops the driving of the motor 70 when the paper feed operation of the preceding sheet 9 is completed. Then, at the paper feed timing of the next sheet 9, the paper feed controller 61 restarts the driving of the motor 70 and starts feeding the next sheet 9, on condition that the sheet determination unit 62 determines that the sheet 9 can be delivered. On the other hand, at the paper feed timing of the next sheet 9, if it is determined that the sheet 9 cannot be delivered due to an empty state of the sheet 9 or the like, the paper feed controller 61 does not restart the driving of the motor 70, but suspends the continuous sheet feeding of the sheet 9.

The position adjustment unit 63 adjusts the height position of the holding member 42 by driving the lift drive unit 41 including a motor to move the holding member 42 that holds the sheet 9 up and down. For example, although the sheet 9 is stored in the sheet storage 40, when the upper limit detection sensor 16 detects that the sheet 9 is not at the predetermined upper limit position, the position adjustment unit 63 drives the lift drive unit 41 to move the holding member 42 upward such that the upper surface of the sheet 9 held by the holding member 42 is pressed against the lower portion of the pick roller 10.

Figure 4A:
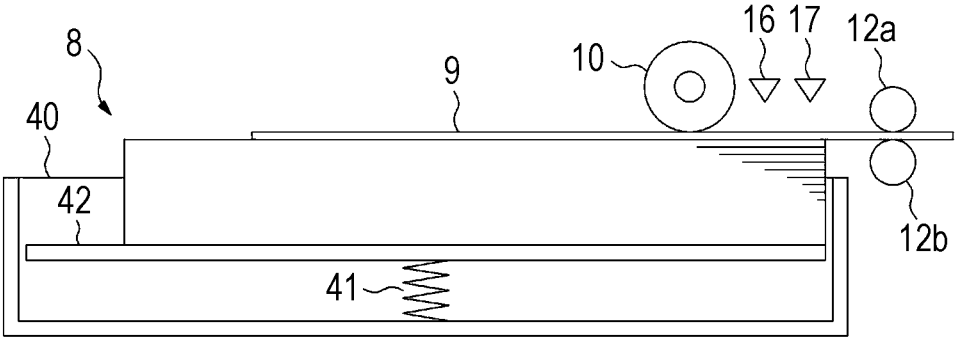
FIGS. 4A to 4C are views illustrating examples of a movement form of a holding member.
Figure 4B:
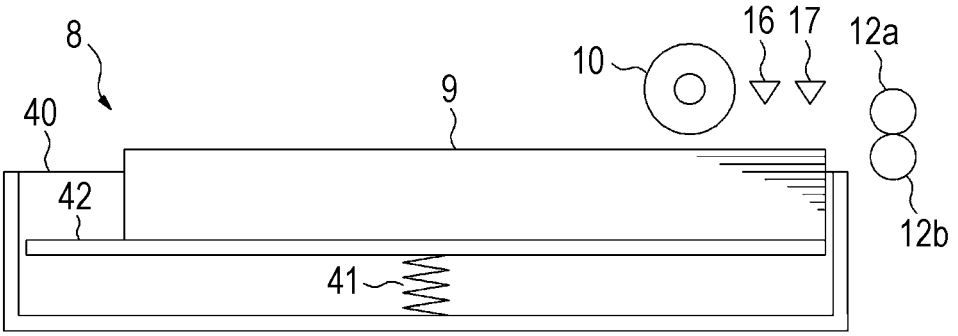
Figure 4C:
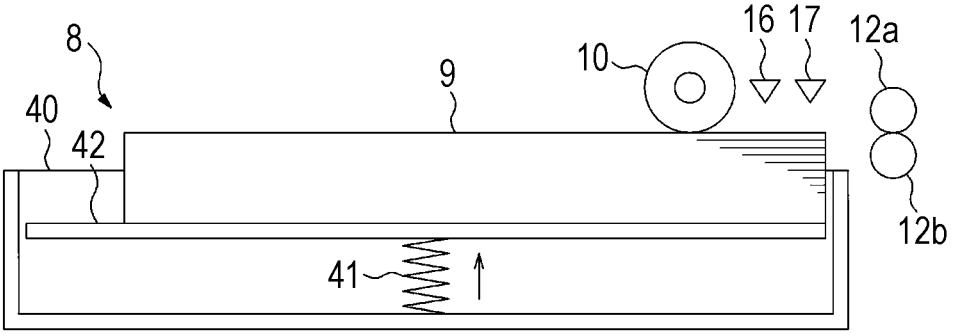

FIGS. 4A to 4C are views illustrating examples of a movement form of the holding member 42 by the position adjustment unit 63. For example, as illustrated in FIG. 4A, when the sheet 9 held by the holding member 42 is pressed against the pick roller 10 by a predetermined pressing force due to the upward movement of the holding member 42 by the position adjustment unit 63, the upper limit detection sensor 16 detects that the sheet 9 is at a predetermined upper limit position and is turned on. If the upper surface of the sheet 9 is in contact with the pick roller 10 as illustrated in FIG. 4A, the sheet 9 can be delivered by the pick roller 10. Therefore, the paper feed controller 61 feeds the sheets 9 one by one. Each time the sheet 9 is fed, the upper surface position of the sheet 9 held by the holding member 42 lowers, and eventually the upper surface of the sheet 9 is separated from the lower surface of the pick roller 10 as illustrated in FIG. 4B. In this way, when the upper surface of the sheet 9 is separated from the lower surface of the pick roller 10, the upper limit detection sensor 16 detects that the sheet 9 is not at the predetermined upper limit position, and is turned off. Although it depends on the type of the sheet 9, the paper feed controller 61 can feed several sheets 9 between the time when the upper limit detection sensor 16 turns on and the time when it turns off.

After the paper feed operation is performed by the paper feed controller 61, when the sheet determination unit 62 determines that the pick roller 10 cannot deliver the sheet 9, the position adjustment unit 63 drives the lift drive unit 41 as illustrated in FIG. 4C to raise the holding member 42 until the upper limit detection sensor 16 turns on. As a result, the sheet 9 can be delivered by the pick roller 10. However, as illustrated in FIG. 4C, the operation of raising the holding member 42 subsequent to the paper feed operation by the paper feed controller 61 is performed on condition that the empty state of the sheet 9 is not detected by the empty sensor 17.

When the empty sensor 17 detects the empty of the sheet 9 after the paper feed operation by the paper feed controller 61 is finished, even if the holding member 42 is raised, the pick roller 10 is not in a state where the sheet 9 can be delivered. In this case also, the sheet determination unit 62 determines that the pick roller 10 cannot feed the sheet 9 by the pick roller 10.

When the empty sensor 17 detects the empty of the sheet 9, the position adjustment unit 63 lowers the holding member 42 to the sheet replenishment position which is the initial position, and raises the holding member 42 again after the sheet 9 is replenished by a user.

Figure 5A:
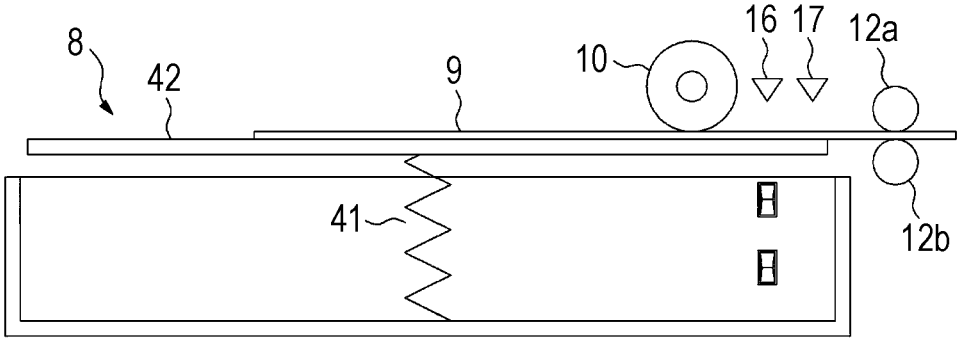
FIGS. 5A to 5D are views illustrating examples of a movement form of a holding member different from that in FIGS. 4A to 4C.
Figure 5B:
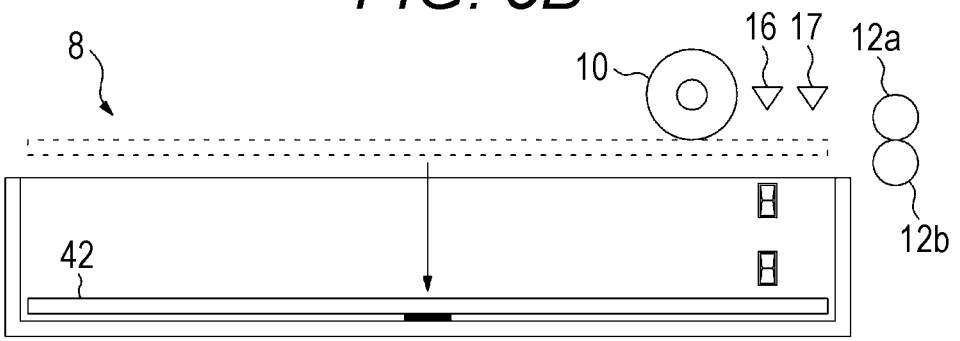

FIGS. 5A to 5D are views illustrating examples of a movement form of the holding member 42 different from that in FIGS. 4A to 4C. For example, as illustrated in FIG. 5A, when the pick roller 10 deliver the final sheet 9, and the final sheet 9 is fed to the conveyance path 13 by the paper feed roller 12*a*, the sheet 9 is not present in the holding member 42. For example, the empty sensor 17 is turned on when the sheet 9 is present in the holding member 42, and is turned off when the sheet 9 is not present in the holding member 42. By changing the output of the empty sensor 17 from the ON state to the OFF state, the sheet determination unit 62 can detect the empty state of the sheet 9. When the empty state of the sheet 9 is detected, as illustrated in FIG. 5B, the position adjustment unit 63 drives the lift drive unit 41, lowers the holding member 42 to the sheet replenishment position, and waits until the user replenishes the sheet 9.

Figure 5C:
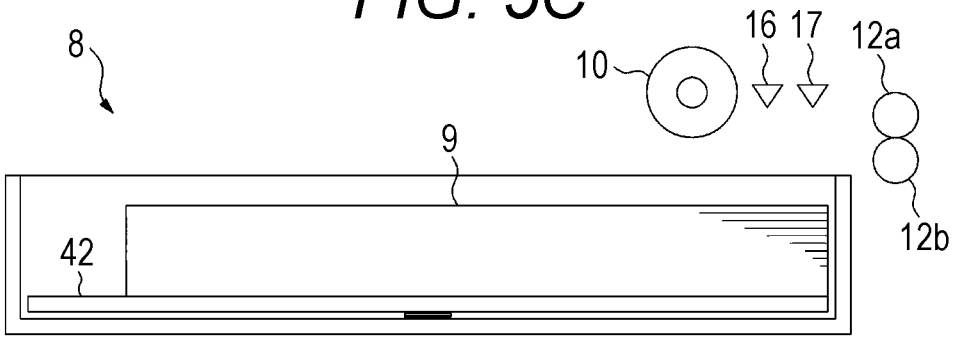

After the user pulls out the paper feed cassette 8 and replenishes the sheet 9, the paper feed cassette 8 is mounted to the paper feeder 2 again. As illustrated in FIG. 5C, when the sheet 9 is replenished in the paper feed cassette 8, on condition that the empty sensor 17 detects the sheet 9, the sheet determination unit 62 identifies the remaining amount of the sheets 9 replenished in the paper feed cassette 8 based on the on/off states of a plurality of the remaining amount detection sensors 43 and 44. Then, a replenishment completion notice of the sheet 9 is output to the position adjustment unit 63.

Figure 5D:
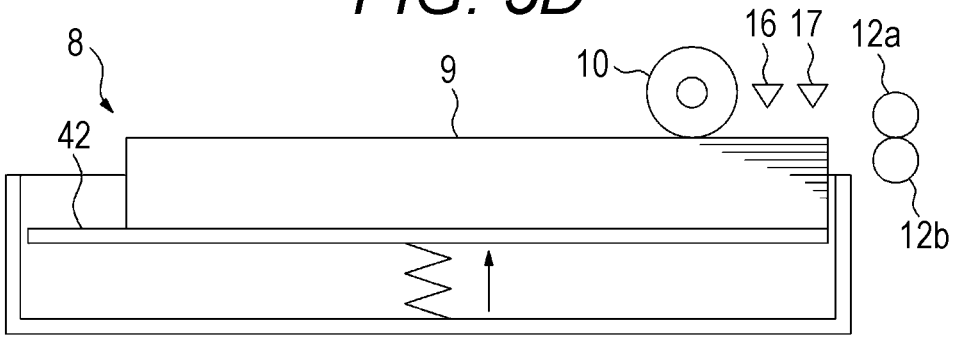

When the position adjustment unit 63 receives the replenishment completion notice of the sheet 9, the position adjustment unit 63 drives the lift drive unit 41, and as illustrated in FIG. 5D, it moves the holding member 42 upward toward the pick roller 10, and presses the upper surface of the replenished sheet 9 against the lower portion of the pick roller 10. At this time also, the position adjustment unit 63 drives the holding member 42 upward until the upper limit detection sensor 16 detects that the sheet 9 has reached the predetermined upper limit position. As a result, the sheet 9 can be delivered by the pick roller 10.

The cleaning execution unit 64 controls the cleaning operation for removing paper dust adhering to the paper feed roller 12*a*. The cleaning execution unit 64 determines whether or not the conveying force of the sheet 9 by the paper feed roller 12*a* has decreased. For example, the cleaning execution unit 64 counts the number of sheets fed by the paper feeder 2, determines that the conveying force of the paper feed roller 12*a* has decreased when the count value is equal to or larger than the predetermined number of sheets, and determines to clean the paper feed roller 12*a*. The predetermined number of sheets as a reference for cleaning is set in advance in the cleaning information 53, for example. Therefore, the cleaning execution unit 64 determines whether to clean the paper feed roller 12*a* based on the cleaning information 53 stored in the memory 51.

When determining to perform cleaning, with the determination that the sheet 9 cannot be delivered by the pick roller 10 by the sheet determination unit 62, the cleaning execution unit 64 drives the motor 70, which is a common drive source for the pick roller 10 and the paper feed roller 12*a*, to clean the paper feed roller 12*a*. For example, if the cleaning execution unit 64 drives the motor 70 while the sheet determination unit 62 determines that the sheet 9 can be delivered by the pick roller 10, the sheet 9 is delivered to the downstream side of the conveyance path 13, and there is a possibility that a jam occurs. In order to prevent the occurrence of such a jam, the cleaning execution unit 64 drives the motor 70 when the sheet determination unit 62 determines that the pick roller 10 cannot deliver the sheet 9. More specifically, when the lower portion of the pick roller 10 is not in contact with the sheet 9, the cleaning execution unit 64 drives the motor 70 to causes the pick roller 10 to idle, while rotating the paper feed roller 12*a* while pressing the separation roller 12*b* against the surface of the paper feed roller 12*a*. Thereby, the paper dust adhering to the surface of the paper feed roller 12*a* is removed by frictional force between the paper feed roller 12*a* and the separation roller 12*b*. Since such a cleaning operation does not require the use of a dedicated cleaning member, it does not lead to an increase in the size of the apparatus or an increase in cost.

For example, when the upper limit detection sensor 16 detects that the sheet 9 is not at the predetermined upper limit position with the sheet 9 remaining in the paper feed cassette 8, as described above, the position adjustment unit 63 drives the lift drive unit 41, and the holding member 42 is moved up. It takes a certain time from the start of the upward movement of the holding member 42 until the upper limit detection sensor 16 is turned on. Therefore, the cleaning execution unit 64 drives the motor 70 until the upper limit detection sensor 16 is turned on, such that the cleaning operation of the paper feed roller 12*a* can be performed in a state where the sheet 9 is not delivered by the pick roller 10.

Figure 6:
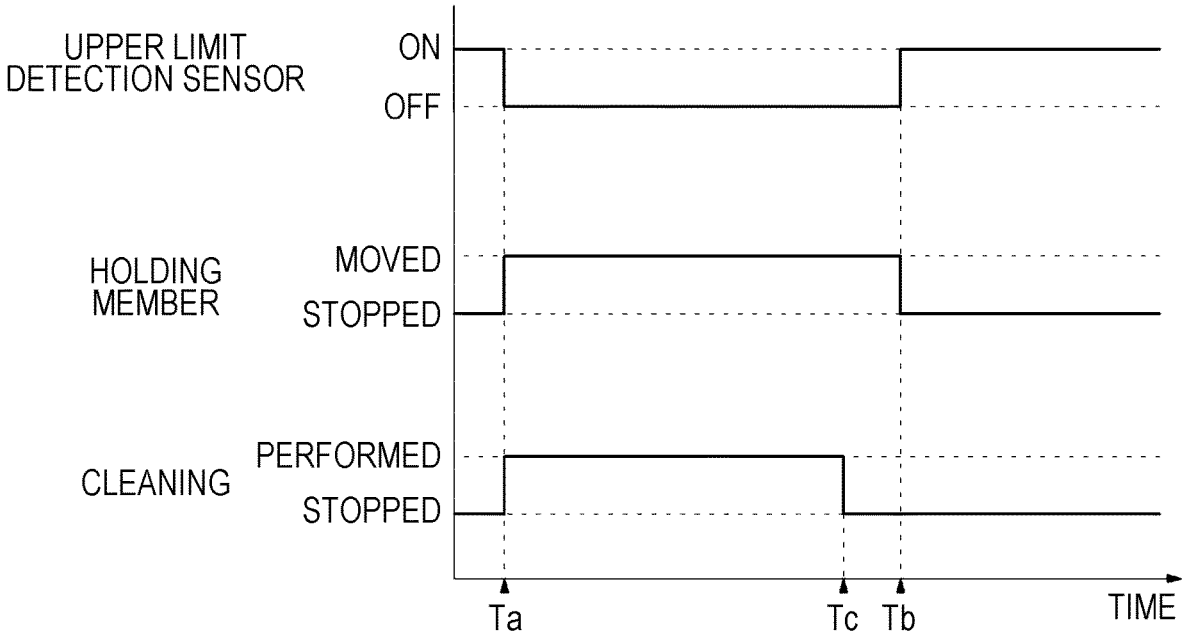
FIG. 6 is a timing chart illustrating an example of a cleaning operation performed by a cleaning execution unit.

FIG. 6 is a timing chart illustrating an example of the cleaning operation by the cleaning execution unit 64. The holding member 42 starts to move upward at the timing Ta when the upper limit detection sensor 16 changes from the ON state to the OFF state. At this time, the cleaning execution unit 64 drives the motor 70 to start cleaning the paper feed roller 12*a*.

The holding member 42 is driven until the timing Tb at which the upper limit detection sensor 16 is turned on. However, the sheet 9 held by the holding member 42 contacts the lower portion of the pick roller 10 immediately before the upper limit detection sensor 16 is turned on. Therefore, if cleaning is performed by the cleaning execution unit 64 until the timing Tb at which the upper limit detection sensor 16 is turned on, the sheet 9 that contacts the lower portion of the pick roller 10 is delivered to the downstream side of the conveyance path 13. To avoid this, the cleaning execution unit 64 starts cleaning the paper feed roller 12*a* at the timing Ta, and ends the cleaning at the timing Tc before the sheet 9 comes into contact with the pick roller 10. As a result, it is possible to prevent the sheet 9 from being fed out by the rotation of the pick roller 10 during the cleaning of the paper feed roller 12*a*.

The cleaning execution unit 64 determines the timing Tc at which the cleaning of the paper feed roller 12*a* is stopped based on the movement time information 54. For example, when moving the holding member 42 upward, the position adjustment unit 63 measures the time from the start to the end of the movement of the holding member 42, and sequentially stores the movement time of the holding member 42 in the memory 51 as the movement time information 54. When determining to clean the paper feed roller 12*a*, the cleaning execution unit 64 reads the movement time information 54 from the memory 51, and determines a cleaning time (time from timing Ta to Tc) such that the time is shorter than the movement time of the holding member 42. That is, the timing Tc immediately before the sheet 9 held by the holding member 42 comes into contact with the lower portion of the pick roller 10 is determined. Note that the movement time information 54 does not necessarily have to be measured when the position adjustment unit 63 moves the holding member 42, and it may be information in which a precalculated time is recorded. Further, the cleaning execution unit 64 may calculate the movement time of the holding member 42 when cleaning the paper feed roller 12*a*, and stop the motor 70 before the movement time elapses.

Further, even when the sheet 9 stored in the paper feed cassette 8 is in the empty state, the sheet determination unit 62 determines that the sheet 9 cannot be delivered by the pick roller 10. In this case, the holding member 42 is lowered to the sheet replenishment position which is the initial position by the position adjustment unit 63 as described above. Therefore, by driving the motor 70 after the movement of the holding member 42 by the position adjustment unit 63 is started, the cleaning execution unit 64 can perform the cleaning operation of the paper feed roller 12*a* in a state where the sheet 9 is not delivered by the pick roller 10.

Figure 7A:
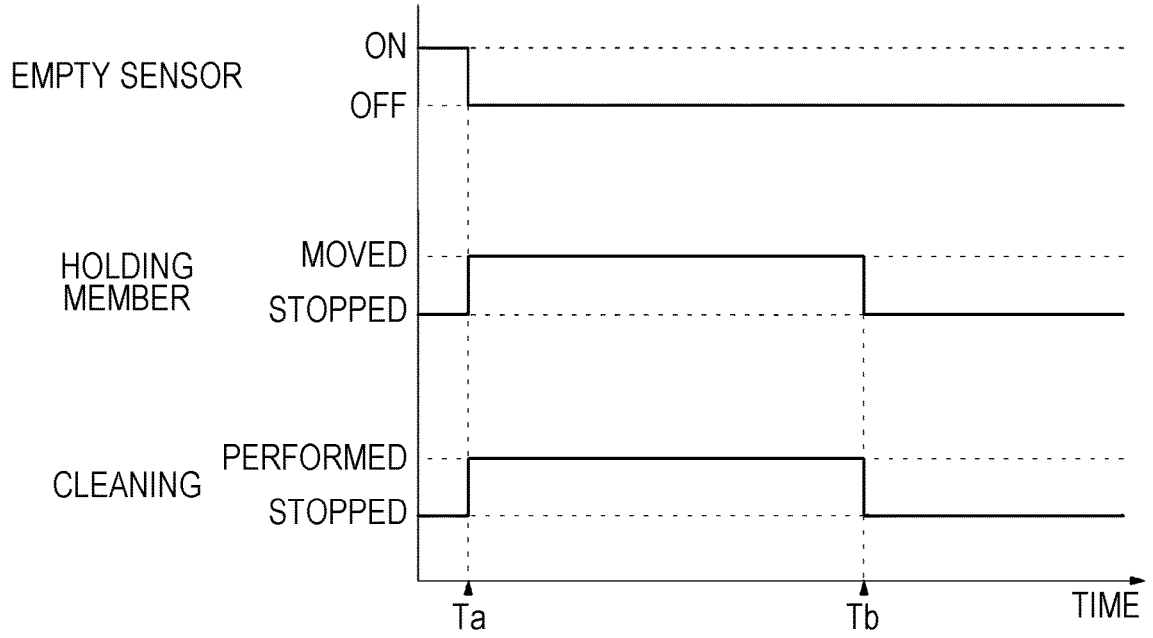
FIGS. 7A and 7B are timing charts illustrating examples of a cleaning operation when a sheet empty is detected.
Figure 7B:
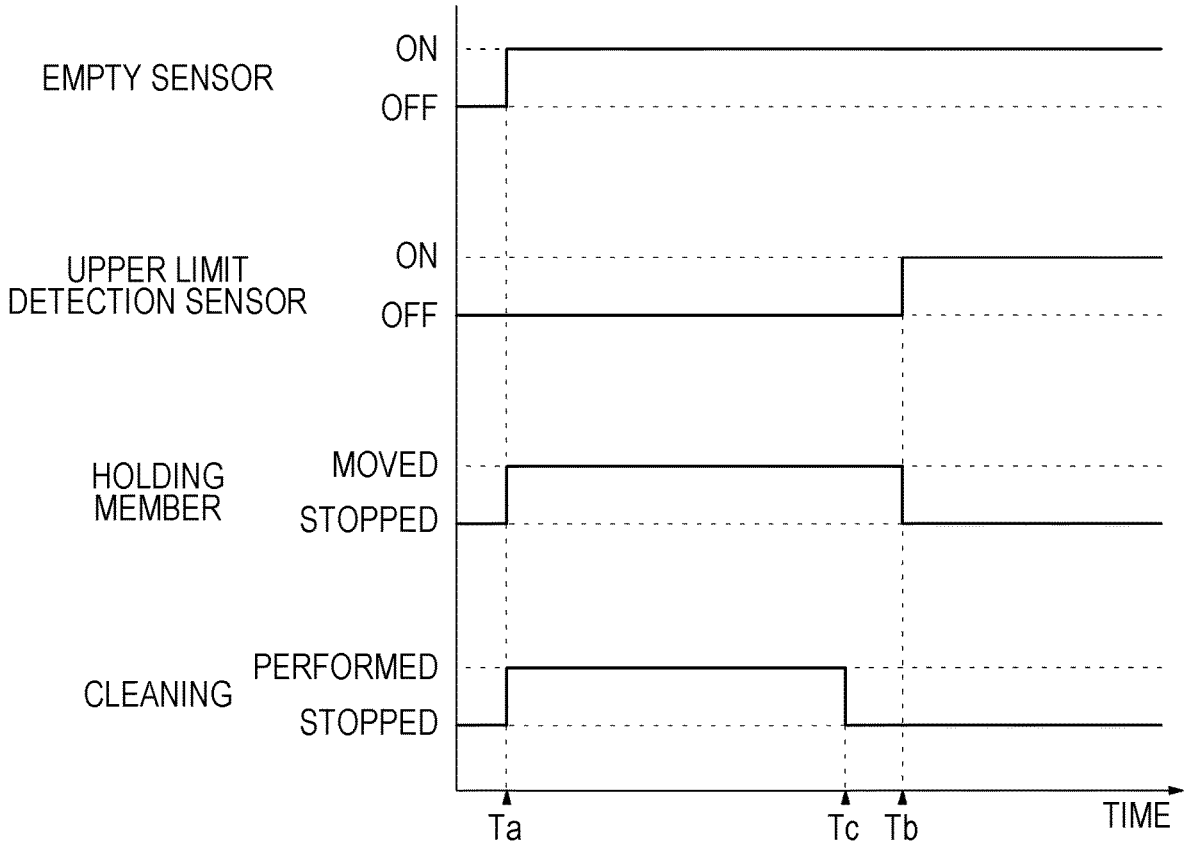

FIGS. 7A and 7B are timing charts illustrating examples of a cleaning operation when the empty state of the sheet 9 is detected. First, as illustrated in FIG. 7A, when the empty sensor 17 detects the empty state of the sheet 9 and turns off, the holding member 42 starts the downward movement toward the sheet replenishment position (timing Ta). The cleaning execution unit 64 drives the motor 70 to clean the paper feed roller 12*a* as the holding member 42 starts to move downward. At this time, the cleaning execution unit 64 preferably starts driving the motor 70 after the position adjustment unit 63 starts driving the lift drive unit 41. Because, when the empty state of the sheet 9 is detected, the lower portion of the pick roller 10 may be in contact with the surface of the holding member 42, and when the pick roller 10 is rotated simultaneously with the lowering of the holding member 42, the surface of the pick roller 10 may be damaged by the friction between the pick roller 10 and the holding member 42. When starting cleaning the paper feed roller 12*a*, the cleaning execution unit 64 continues the cleaning until the timing Tb at which the movement of the holding member 42 stops. As described above, when the separation roller 12*b* is separated from the paper feed roller 12*a* when the paper feed cassette 8 is pulled out from the apparatus main body 1*a*, even if the paper feed roller 12*a* is cleaned after the paper feed cassette 8 is pulled out, the paper dust cannot be removed. Therefore, when the holding member 42 is lowered to the sheet replenishment position, the cleaning execution unit 64 performs cleaning until the lowering operation of the holding member 42 is completed.

In addition, the holding member 42 is driven by the position adjustment unit 63 even when the paper feed cassette 8 with the sheets 9 replenished is mounted to the apparatus main body 1*a*. In this case also, it takes a certain time from the start of the upward movement of the holding member 42 until the upper limit detection sensor 16 is turned on. Therefore, from when the paper feed cassette 8 is mounted, the cleaning execution unit 64 drives the motor 70 until the upper limit detection sensor 16 is turned on, such that the cleaning operation of the paper feed roller 12*a* can be performed in a state where the sheet 9 is not delivered by the pick roller 10. As illustrated in FIG. 7B, when the sheet 9 is replenished in the paper feed cassette 8, the empty sensor 17 is turned on, and it is detected that the sheet 9 has been replenished. The holding member 42 starts to move upward at the timing Ta when it is detected that the sheet 9 has been replenished. Then, the cleaning execution unit 64 drives the motor 70 at the timing Ta when the upward movement of the holding member 42 is started, and cleans the paper feed roller 12*a*. In this case also, the cleaning execution unit 64 ends the cleaning operation at the timing Tc before the timing Tb at which the upper limit detection sensor 16 is turned on.

When the paper feed cassette 8 is mounted to the apparatus main body 1*a* with the sheets 9 being replenished, the time for the position adjustment unit 63 to drive the lift drive unit 41 to move the holding member 42 upward varies depending on the amount of replenishment of the sheet 9. Therefore, the cleaning execution unit 64 determines the timing (timing Tc in FIG. 7B) at which the cleaning operation is ended depending on the remaining amount of the sheet 9 specified by the sheet determination unit 62. For example, the cleaning execution unit 64 refers to the remaining amount of the sheet 9 specified based on the on/off state of the two remaining amount detection sensors 43 and 44, and calculates the movement time of the holding member 42 required until the upper limit detection sensor 16 is turned on based on the remaining amount. Then, the cleaning execution unit 64 determines the time to drive the motor 70 for cleaning the paper feed roller 12*a* based on the movement time.

Figure 8:
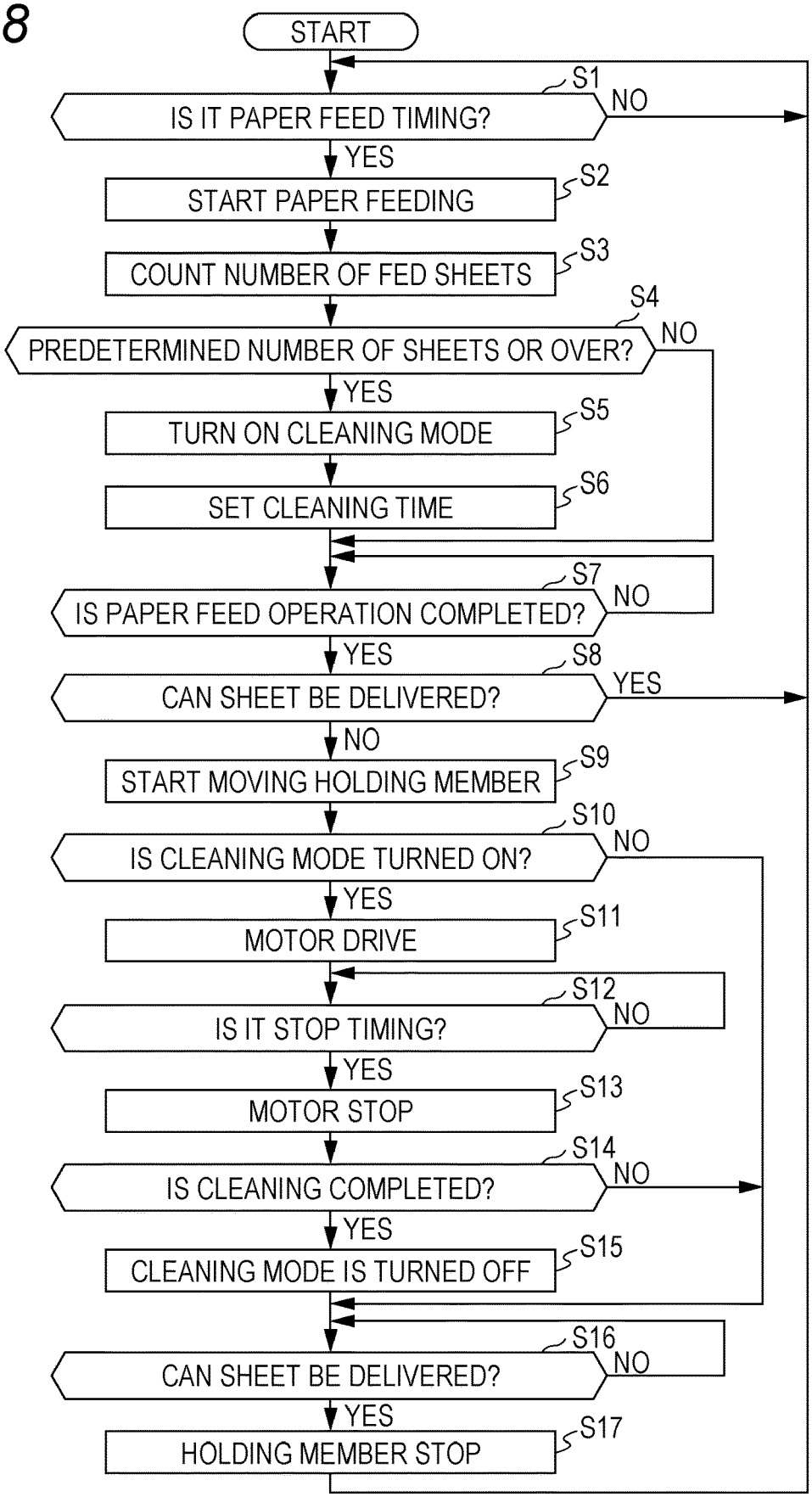
FIG. 8 is a flowchart illustrating an example of a processing procedure performed by a controller of a first embodiment.

Next, an example of a specific operation of the controller 7 having the above configuration will be described. FIG. 8 is a flowchart illustrating an example of a processing procedure performed by the controller 7. This process is a process performed in the controller 7 by the CPU 50 executing the program 52, and is a process repeatedly performed in the controller 7.

When starting the processes based on the flowchart illustrated in FIG. 8, the controller 7 first determines whether or not it is the paper feed timing for feeding the sheet 9 (step S1). When it is the paper feed timing (YES in step S1), the controller 7 starts the paper feed operation of one sheet 9 by driving the motor 70 to rotate the pick roller 10 and the paper feed roller 12*a* (Step S2). When the paper feed operation of the sheet 9 is started, the controller 7 counts the number of fed sheets (step S3). That is, the controller 7 updates the number of fed sheets by adding one to the number of fed sheets up to that point. Subsequently, the controller 7 reads the cleaning information 53 and refers to the cleaning information 53 to determine whether or not the number of fed sheets is equal to or larger than a predetermined number (step S4).

FIG. 9 is a diagram illustrating an example of the cleaning information 53. For example, as illustrated in FIG. 9, the cleaning information 53 is information in which the number of fed sheets that require cleaning of the paper feed roller 12*a* (the number of sheets required for cleaning) and the cleaning time are associated with each other. The controller 7 determines whether the number of fed sheets is equal to or larger than the number of sheets required for cleaning by referring to such cleaning information 53.

When the number of fed sheets is equal to or larger than the predetermined number (YES in step S4), the controller 7 determines to clean the paper feed roller 12*a* and sets the cleaning mode to ON (step S5). Then, the controller 7 refers to the cleaning information 53 to set the cleaning time corresponding to the current number of fed sheets (step S6). This cleaning time is the drive time of the motor 70 necessary for removing the paper dust adhering to the paper feed roller 12*a*. For example, when the number of fed sheets is relatively small, since the recessed portion due to emboss processing applied to the surface of the paper feed roller 12*a* is deep, a lot of paper dust may adhere, and the cleaning time becomes relatively long. On the other hand, when the number of fed sheets relatively large, since the recessed portion due to emboss processing is shallow due to wear, the amount of paper dust is small, and the cleaning time is relatively short. Thus, the cleaning information 53 defines the cleaning time according to the number of fed sheets fed by the paper feeder 2. Therefore, the controller 7 can set the cleaning time suitable for the deterioration state of the paper feed roller 12*a* by referring to the cleaning information 53. Note that if the number of fed sheets is not equal to or larger than the predetermined number of sheets (NO in step S4), the process by the controller 7 proceeds to step S7.

Next, the controller 7 determines whether or not the paper feed operation started in step S2 is completed (step S7). If the paper feed operation is not completed (NO in step S7), the process stands by until the paper feed operation is completed. When the paper feed operation is completed (YES in step S7), the controller 7 determines whether or not the sheet 9 can be delivered by the pick roller 10 based on the outputs from the upper limit detection sensor 16 and the empty sensor 17 (step S8). For example, when the upper limit detection sensor 16 detects that the sheet 9 is not present at a predetermined upper limit position in a state where the empty sensor 17 does not detect the empty state of the sheet 9, or when the empty sensor 17 detects the empty state of the sheet 9, the controller 7 determines that the pick roller 10 cannot deliver the sheet 9. When the controller 7 determines that the sheet 9 can be delivered by the pick roller 10 (YES in step S8), returning to step S1, and the above-described processing is repeated. That is, when the sheet 9 can be delivered by the pick roller 10, the paper feed roller 12*a* is not cleaned.

On the other hand, when it is determined that the sheet cannot be delivered by the pick roller 10 (NO in step S8), the controller 7 drives the lift drive unit 41 to start moving the holding member 42 (step S9). When the movement of the holding member 42 is started, the controller 7 determines whether or not the cleaning mode is set to ON (step S10). When the cleaning mode is set to ON (YES in step S10), the controller 7 drives the motor 70 to start cleaning the paper feed roller 12*a* when the holding member 42 starts moving (step S11). At this time, the controller 7 refers to the movement time information 54, and predetermines the stop timing Tc for stopping the motor 70 based on the time required to complete the movement of the holding member 42. Then, after starting the driving of the motor 70, the controller 7 continues the driving by the motor 70 until the stop timing Tc is reached (step S12). As a result, the pick roller 10 idles while the paper feed roller 12*a* rotates in a state of being in contact with the separation roller 12*b*, such that paper dust adhered to the surface of the paper feed roller 12*a* is removed.

Then, when the predetermined stop timing Tc is reached, the controller 7 stops the motor 70 and ends the cleaning operation of the paper feed roller 12*a* (step S13).

When the controller 7 stops the motor 70, the controller 7 determines whether or not the cleaning for the cleaning time set in step S6 is completed (step S14). That is, by comparing the cumulative time of driving the motor 70 for cleaning and the cleaning time set in step S6, it is determined whether or not cleaning corresponding to the current number of fed sheets has been completed. As a result, when cleaning corresponding to the current number of fed sheets is completed (YES in step S14), the controller 7 sets the cleaning mode to OFF (step S15). On the other hand, when the cleaning corresponding to the current number of fed sheets is not completed (NO in step S14), the controller 7 does not turn off the cleaning mode. In this case, when it is determined that the sheet 9 cannot be delivered next, the motor 70 is driven again, and the paper feed roller 12*a* is cleaned.

After that, the controller 7 determines whether or not the sheet 9 can be delivered by the pick roller 10 (step S16). That is, when the upper limit detection sensor 16 detects that the sheet 9 has reached the predetermined upper limit position, the controller 7 determines that the sheet 9 can be delivered. When the sheet 9 can be delivered by the pick roller 10, the controller 7 ends the driving of the lift drive unit 41, and the holding member 42 is stopped (step S17). After that, the processing by the controller 7 returns to step S1 and repeats the above-described processing.

As described above, the image forming apparatus 1 of the present embodiment drives the motor 70 when the pick roller 10 cannot feed the sheet 9, and removes the paper dust adhering to the paper feed roller 12*a* by bringing the paper feed roller 12*a* into contact with the separation roller 12*b* and rotating in a state where the sheet 9 is not fed out from the pick roller 10. That is, the image forming apparatus 1 does not need to be provided with a dedicated cleaning member as in the conventional case since the paper feed roller 12*a* can be cleaned by rotating the paper feed roller 12*a* in contact with the existing separation roller 12*b*. Therefore, the image forming apparatus 1 according to the present embodiment can suppress an increase in size of the apparatus and an increase in cost.

In particular, the image forming apparatus 1 of the present embodiment can clean the paper feed roller 12*a* when the pick roller 10 cannot feed the sheet 9, even if the sheet 9 is stored in the paper feed cassette 8. Therefore, even if the image forming apparatus 1 is executing a print job, it is possible to properly clean the paper feed roller 12*a*.

Further, the image forming apparatus 1 according to the present embodiment cleans the paper feed roller 12*a* during a period in which the pick roller 10 cannot feed the sheet 9 regardless of the type of the sheet 9. Therefore, the image forming apparatus 1 also has an advantage that it is not necessary to determine the type of sheets 9 stored in the paper feed cassette 8, and the paper feed roller 12*a* can be properly cleaned.

Further, the image forming apparatus 1 may execute an image stabilization process as an interrupt during the execution of a print job in order to stabilize a toner image formed by the image forming unit 3. In that case, the image forming apparatus 1 temporarily suspends the paper feed operation by the paper feeder 2, and only the image forming unit 3 is operated to execute the image stabilization process. When the execution of this image stabilization process is started, it takes a certain time to finish. Therefore, the controller 7 may lower the holding member 42 to the sheet replenishment position when the image stabilization process by the image forming unit 3 is executed, and may drive the motor 19 to clean the paper feed roller 12*a* after the sheet 9 is not delivered by the pick roller 10.

Further, the controller 7 may lower the holding member 42 to the sheet replenishment position even when the execution of the print job is interrupted by a user, and may drive the motor 19 to clean the paper feed roller 12*a* after the sheet 9 is not delivered by the pick roller 10. Then, the controller 7 moves the holding member 42 upward after the cleaning of the paper feed roller 12*a* is completed, such that a sheet can be fed by the pick roller 10, and the print job can be continued.

In the above description, the pick roller 10 and the paper feed roller 12*a* are driven by the motor 70 provided as a common drive source. However, even if the pick roller 10 and the paper feed roller 12*a* are driven by different drive sources, when the drive source that drives the pick roller 10 and the drive source that drives the paper feed roller 12*a* operate at the same timing, and when the paper feed roller 12*a* is driven for cleaning, the sheet 9 is fed out by the pick roller 10, which causes a problem that normal cleaning cannot be performed. Therefore, as described above, cleaning can be normally performed by driving the paper feed roller 12*a* when the pick roller 10 cannot feed the sheet 9. Therefore, the drive sources for the pick roller 10 and the paper feed roller 12*a* are not necessarily common.

Second Embodiment

Next, a second embodiment according to the present invention will be described. The above-described first embodiment exemplifies the case where it is determined whether or not the conveying force of the sheet 9 by the paper feed roller 12*a* has decreased based on the number of fed sheets fed by the paper feeder 2. However, the determination based on the number of fed sheets cannot accurately determine whether or not the actual conveying force of the paper feed roller 12*a* has decreased. Therefore, in the present embodiment, a configuration example capable of more accurately determining whether or not the conveying force of the paper feed roller 12*a* has decreased will be described. Note that the configurations of an image forming apparatus 1 and a paper feeder 2 in the present embodiment are the same as those described in the first embodiment.

As described in the first embodiment, the paper feeder 2 includes two sheet detection sensors 18*a* and 18*b* at different positions on a conveyance path 13 on the downstream side of a paper feed roller 12*a*. By measuring a time required for fed sheets 9 to pass through the positions of those two sheet detection sensors 18*a* and 18*b*, a cleaning execution unit 64 can determine whether or not the conveyance force of the paper feed roller 12*a* has decreased.

Figure 10A:
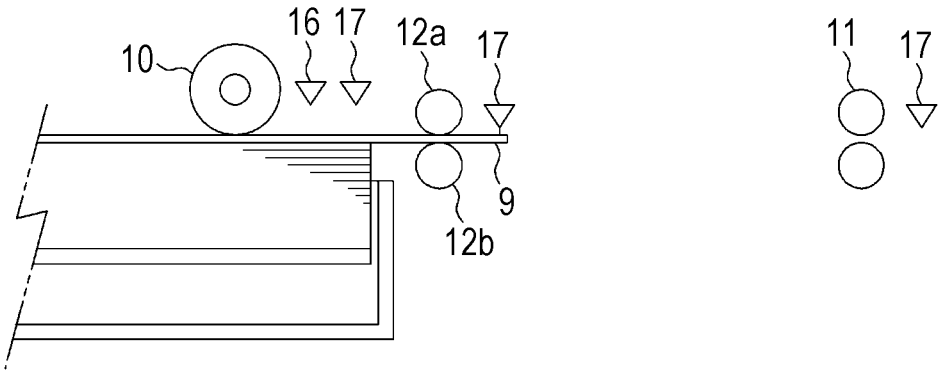
FIGS. 10A and 10B are views illustrating examples of a conveyance state of a sheet fed by a paper feed roller.
Figure 10B:
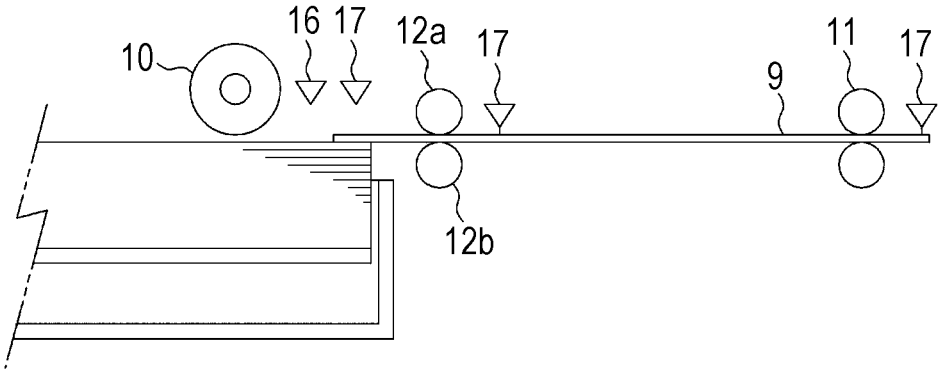

FIGS. 10A and 10B are views illustrating examples of a conveyance state of the sheet 9 fed by the paper feed roller 12*a*. As illustrated in FIG. 10A, when the paper feeding operation of the sheet 9 is started by the paper feeder 2, the sheet 9 is first detected by the first sheet detection sensor 18*a*. Then, as illustrated in FIG. 10B, the sheet 9 is detected by the second sheet detection sensor 18*b*. The cleaning execution unit 64 measures a paper feed time required from the detection of the sheet 9 by the first sheet detection sensor 18*a* to the detection of the sheet 9 by the second sheet detection sensor 18*b*. As long as the conveyance force of the paper feed roller 12*a* is not reduced, the paper feed time is within a certain range. On the other hand, when the conveyance force of the paper feed roller 12*a* is reduced, the paper feed time becomes longer and exceeds the certain range. Therefore, the cleaning execution unit 64 measures the paper feed time each time the paper feed operation is performed by the paper feeder 2, and if the paper feed time exceeds the certain time, the cleaning execution unit 64 determines that the conveyance force of the paper feed roller 12*a* has decreased, and determines to clean the paper feed roller 12*a*.

Figure 11:
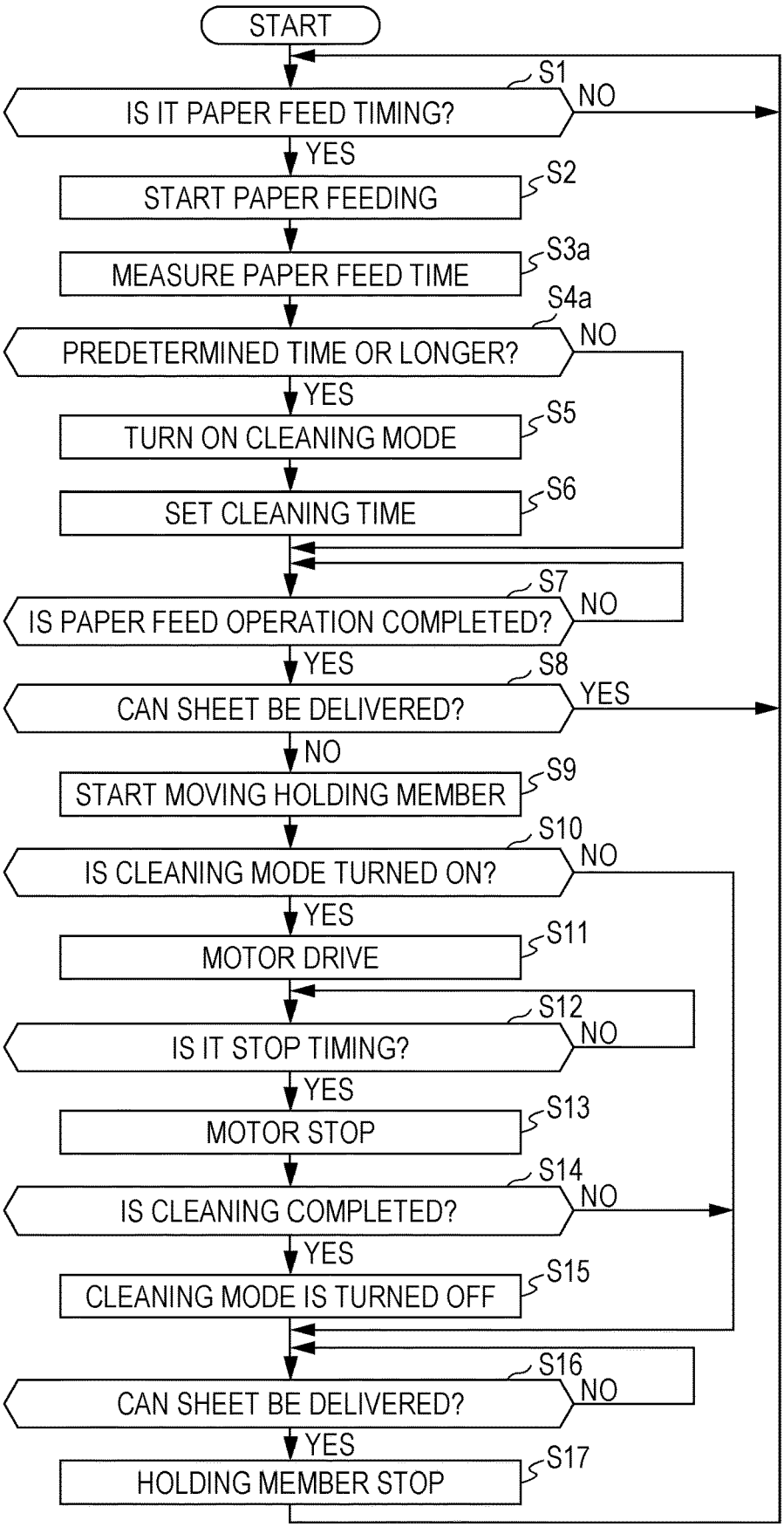
FIG. 11 is a flowchart illustrating an example of a processing procedure performed by a controller of a second embodiment.

FIG. 11 is a flowchart illustrating an example of a processing procedure performed by a controller 7 of the present embodiment. The flowchart illustrated in FIG. 11 is a flowchart replacing the flowchart of FIG. 8 described in the first embodiment, and the processing different from the flowchart of FIG. 8 is two steps S3*a* and S4*a*.

When the paper feed operation of the sheet 9 is started, the controller 7 measures the paper feed time (step S3*a*) and determines whether the measured paper feed time is a predetermined time or more (step S4*a*). When the paper feed time is equal to or longer than the predetermined time (YES in step S4*a*), the controller 7 determines that the feeding force of the paper feed roller 12*a* is reduced, determines to clean the paper feed roller 12*a*, and sets the cleaning mode to ON (step S5). Therefore, the image forming apparatus 1 of the present embodiment can clean the paper feed roller 12*a* when the paper dust adhered to the paper feed roller 12*a* reduces the conveyance force of the paper feed roller 12*a*. Note that the processing after step S5 is the same as that in the flowchart of FIG. 8.

As described above, when the sheet 9 is fed by the paper feed roller 12*a*, the image forming apparatus 1 of the present embodiment measures the paper feed time required for the sheet 9 to be conveyed by a certain distance, and determines whether or not to clean the paper feed roller 12*a* based on the paper feed time. Therefore, cleaning is not performed even though the conveyance force of the paper feed roller 12*a* is not reduced, and the cleaning can be performed at an appropriate timing.

The present embodiment is the same as the one described in the first embodiment except for the points described above.

Third Embodiment

Figure 12:
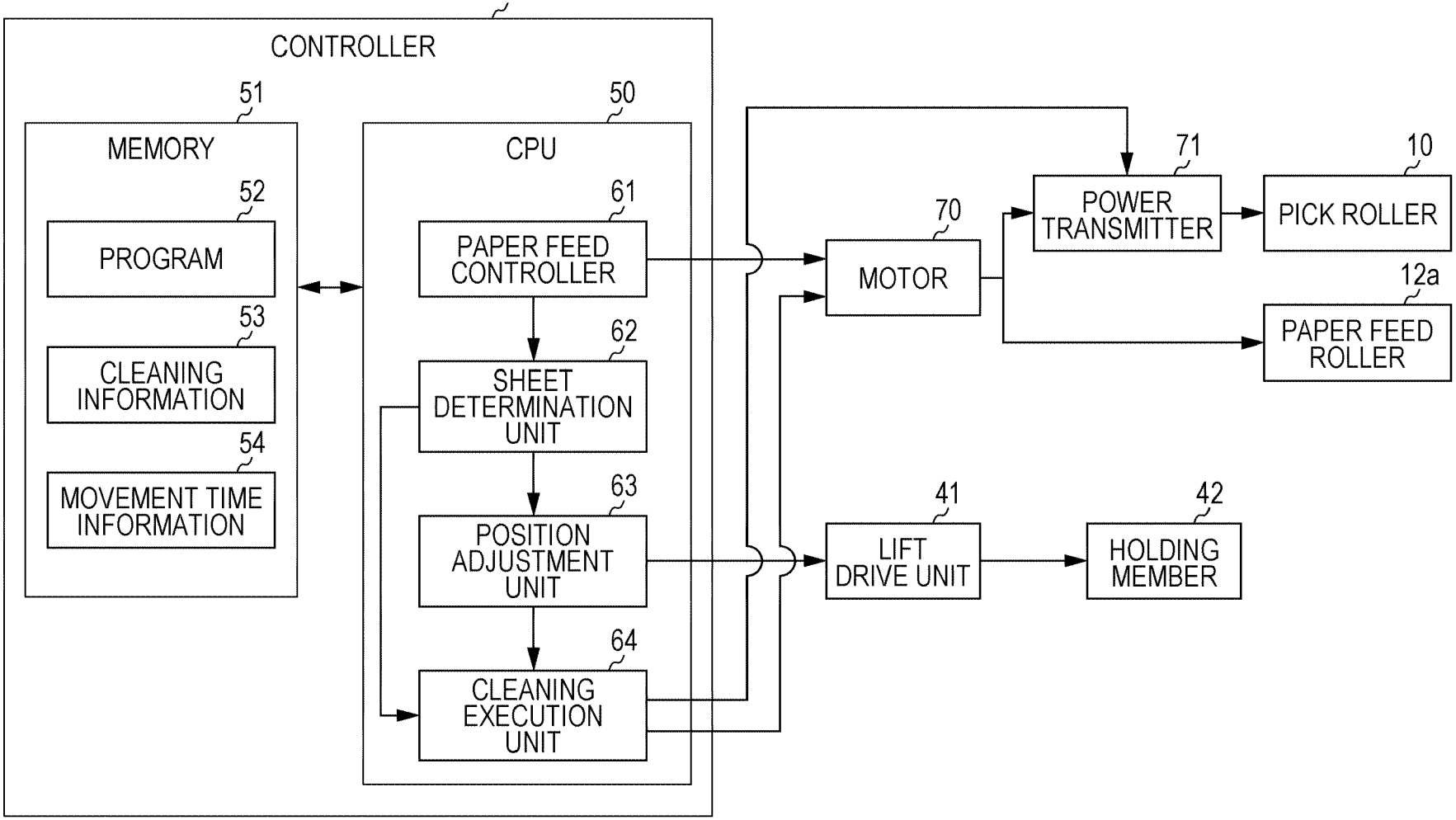
FIG. 12 is a block diagram illustrating a configuration example of a controller of a third embodiment.

Next, a third embodiment according to the present invention will be described. FIG. 12 is a block diagram illustrating a configuration example of a controller 7 in the third embodiment. In the present embodiment also, a motor 70 still drives both a pick roller 10 and a paper feed roller 12*a*. However, in the present embodiment, a power transmitter 71 is arranged between the motor 70 and the pick roller 10. The power transmitter 71 includes a clutch mechanism that transmits or blocks rotation between two power transmission shafts, and can enable or disable power transmission from the motor 70 to the pick roller 10.

A cleaning execution unit 64 controls the clutch mechanism of the power transmitter 71. That is, when the motor 70 is driven to clean a paper feed roller 12*a*, the cleaning execution unit 64 disables the power transmission by the power transmitter 71 such that the driving force of the motor 70 is not transmitted to the pick roller 10. As a result, the pick roller 10 does not rotate while the paper feed roller 12*a* is being cleaned, such that the possibility that a sheet 9 is delivered by the pick roller 10 can be eliminated.

Therefore, when cleaning the paper feed roller 12*a* while a holding member 42 is moving, the controller 7 of the present embodiment can perform cleaning from the timing when the movement of the holding member 42 starts to the timing when the movement is completed. For example, when performing cleaning when the holding member 42 is moved upward as illustrated in FIG. 6, the cleaning execution unit 64 can continue the cleaning from a timing Ta at which the movement of the holding member 42 starts to a timing Tb at which the movement of the holding member 42 ends, by switching the power transmission to the pick roller 10 to disabled. Further, the same applies to the case where cleaning is performed when the holding member 42 is moved upward as illustrated in FIG. 7B, the cleaning execution unit 64 can continue the cleaning from the timing Ta at which the movement of the holding member 42 starts to the timing Tb at which the movement of the holding member 42 ends, by switching the power transmission to the pick roller 10 to disabled.

Further, as described in the first embodiment, when cleaning the paper feed roller 12*a* when an image stabilization process is performed in an image forming unit 3, the controller 7 of the present embodiment also has an advantage that cleaning can be performed by driving a motor 19 in a state where power transmission to the pick roller 10 is disabled, without lowering the holding member 42 to a sheet replenishment position.

Note that the present embodiment is the same as the one described in the first embodiment or the second embodiment, except for the points described above.

(Modification)

The preferred embodiments of the present invention have been described above. However, the present invention is not limited to the contents described in the above embodiments, and various modifications can be applied.

For example, in the above-described embodiments, the case where the image forming apparatus 1 is an apparatus that forms an image on the sheet 9 by an electrophotographic method is illustrated. However, the image forming apparatus 1 is not limited to the one that forms an image by an electrophotographic method. For example, the image forming apparatus 1 may be one that forms an image by an inkjet method.

Further, in the above embodiment, the case where the image forming apparatus 1 is a color machine capable of performing color printing is illustrated. However, the image forming apparatus 1 is not limited to a color machine, and may be a monochrome machine.

Further, in the above-described embodiments, the form in which the paper feeder 2 is integrally incorporated in the image forming apparatus 1 has been illustrated. However, the paper feeder 2 may be configured separately from the image forming apparatus 1 and may be attached to the main body of the image forming apparatus 1 afterwards.

Further, in the above embodiments, the case where the program 52 that causes the controller 7 to execute a control method is pre-installed in the controller 7 has been illustrated. However, the program 52 may be installed in the controller 7 via, for example, a communication interface. In this case, the program 52 is provided in a downloadable form via the Internet or the like. Further, the program 52 is not limited to this, and may be provided in a form recorded in a computer-readable recording medium such as a CD-ROM or a USB memory.

Although embodiments of the present invention have been described and illustrated in detail, the disclosed embodiments are made for purposes of illustration and example only and not limitation. The scope of the present invention should be interpreted by terms of the appended claims

What is claimed is:

1. A paper feeder, comprising:

a sheet storage that stores sheets;

a pick roller that delivers the sheets stored in the sheet storage to a downstream side of a conveyance path;

a pair of conveyance rollers that is located on a downstream side of the pick roller in the conveyance path and conveys the sheets delivered from the pick roller to further downstream side in the conveyance path;

a drive source that drives the pick roller and the pair of conveyance rollers;

a power transmitter capable of enabling or disabling power transmission from the drive source to the pick roller; and a hardware processor that:

counts the number of sheets fed by the pair of conveyance rollers, determines a cleaning time in accordance with the number of fed sheets, the cleaning time being a time period during which the drive source is driven for cleaning the pair of conveyance rollers, and cleans the pair of conveyance rollers by driving the drive source to rotate the pair of conveyance rollers in a state of being in contact with each other until a drive time of the drive source reaches the cleaning time, while the pick roller is in contact with the sheets and the power transmitter disables power transmission from the drive source to the pick roller.

2. The paper feeder according to claim 1, wherein the pair of conveyance rollers comprises a paper feed roller driven by the drive source, and a separation roller that is arranged so as to face the paper feed roller with the conveyance path interposed therebetween and separates a plurality of sheets delivered by the pick roller into one sheet, and the hardware processor cleans the paper feed roller by rotating the paper feed roller in contact with the separation roller when the pick roller cannot deliver sheets.

3. The paper feeder according to claim 2, wherein the drive source drives the paper feed roller and the pick roller.

4. The paper feeder according to claim 1, further comprising a detector that detects sheets stored in the sheet storage, wherein the hardware processor determines that a sheet cannot be delivered by the pick roller when the detector detects that the sheet stored in the sheet storage is not present at a predetermined position with respect to the pick roller.

5. The paper feeder according to claim 4, wherein the hardware processor determines that a sheet cannot be delivered by the pick roller when the detector detects that a sheet stored in the sheet storage is not in contact with the pick roller.

6. The paper feeder according to claim 5, further comprising a holding member that holds sheets stored in the sheet storage and is movable back and forth with respect to the pick roller, wherein when a sheet stored in the sheet storage is not in contact with the pick roller, the hardware processor moves the holding member toward the pick roller until a sheet can be delivered by the pick roller, and the hardware processor drives the drive source during a period from when it is determined that a sheet stored in the sheet storage cannot be delivered to when the movement of the holding member ends.

7. The paper feeder according to claim 4, wherein the hardware processor determines that a sheet cannot be delivered by the pick roller when the detector detects that a sheet is not stored in the sheet storage.

8. The paper feeder according to claim 7, further comprising a holding member that holds sheets stored in the sheet storage and is movable back and forth with respect to the pick roller, wherein the hardware processor moves the holding member to a predetermined sheet replenishment position when a sheet is not stored in the sheet storage, and the hardware processor drives the drive source after starting the movement of the holding member to the sheet replenishment position.

9. The paper feeder according to claim 7, further comprising a holding member that holds sheets stored in the sheet storage and is movable back and forth with respect to the pick roller, wherein the hardware processor moves the holding member to a predetermined sheet replenishment position when a sheet is not stored in the sheet storage, the hardware processor moves the holding member from the sheet replenishment position toward the pick roller until a sheet can be delivered by the pick roller after sheets are replenished at the sheet replenishment position, and the hardware processor drives the drive source when moving the holding member from the sheet replenishment position toward the pick roller.

10. The paper feeder according to claim 1, further comprising a holding member that holds sheets stored in the sheet storage and is movable back and forth with respect to the pick roller, wherein the hardware processor moves the holding member when determining that the pick roller cannot deliver a sheet, and drives the drive source when moving the holding member.

11. The paper feeder according to claim 1, further comprising a paper feed detector that is located on a downstream side of the paper feed roller in the conveyance path and detects a sheet fed by the paper feed roller, wherein when a sheet is fed by driving the drive source when a sheet can be delivered by the pick roller, the hardware processor measures a paper feed time from the start of paper feeding until a sheet is detected by the paper feed detector, and cleans the prepare feed roller when the paper feed time is a predetermined time or more.

12. The paper feeder according to claim 11, wherein the hardware processor sets a cleaning time for driving the drive source for cleaning the paper feed roller according to the paper feed time when the paper feed time is the predetermined time or more.

13. The paper feeder according to claim 1, wherein the hardware processor sets a cleaning mode based on an instruction from the outside, and cleans the paper feed roller on condition that the cleaning mode is set.

14. An image forming apparatus, comprising:

the paper feeder according to claim 1; and an image forming unit that forms an image on a sheet fed by the paper feeder.

15. A paper feeder, comprising:

a sheet storage that stores sheets;

a pick roller that delivers the sheets stored in the sheet storage to a downstream side of a conveyance path;

a pair of conveyance rollers that is located on a downstream side of the pick roller in the conveyance path and conveys the sheets delivered from the pick roller to further downstream side in the conveyance path;

a drive source that drives the pair of conveyance rollers;

a detector that detects sheets stored in the sheet storage, a holding member that holds sheets stored in the sheet storage and is movable back and forth with respect to the pick roller;

a hardware processor that cleans the pair of conveyance rollers by driving the drive source to rotate the pair of conveyance rollers in a state of being in contact with each other, when the pick roller cannot deliver sheets; and a memory, wherein the hardware processor determines that a sheet cannot be delivered by the pick roller when the detector detects that the sheet stored in the sheet storage is not present at a predetermined position with respect to the pick roller, wherein the hardware processor determines that a sheet cannot be delivered by the pick roller when the detector detects that a sheet stored in the sheet storage is not in contact with the pick roller, wherein when a sheet stored in the sheet storage is not in contact with the pick roller, the hardware processor moves the holding member toward the pick roller until a sheet can be delivered by the pick roller, and the hardware processor drives the drive source during a period from when it is determined that a sheet stored in the sheet storage cannot be delivered to when the movement of the holding member ends, wherein the memory stores a movement time required from the start of the movement of the holding member to the state in which the pick roller can deliver the sheet, and wherein the hardware processor, when driving the drive source for cleaning the paper feed roller, stops the drive source before the movement time elapses after starting the movement of the holding member.

16. A paper feeder, comprising:

a sheet storage that stores sheets;

a pick roller that delivers the sheets stored in the sheet storage to a downstream side of a conveyance path;

a pair of conveyance rollers that is located on a downstream side of the pick roller in the conveyance path and conveys the sheets delivered from the pick roller to further downstream side in the conveyance path;

a drive source that drives the pair of conveyance rollers;

a detector that detects sheets stored in the sheet storage, a holding member that holds sheets stored in the sheet storage and is movable back and forth with respect to the pick roller; and a hardware processor that cleans the pair of conveyance rollers by driving the drive source to rotate the pair of conveyance rollers in a state of being in contact with each other, when the pick roller cannot deliver sheets, wherein the hardware processor determines that a sheet cannot be delivered by the pick roller when the detector detects that the sheet stored in the sheet storage is not present at a predetermined position with respect to the pick roller, wherein the hardware processor determines that a sheet cannot be delivered by the pick roller when the detector detects that a sheet stored in the sheet storage is not in contact with the pick roller, wherein when a sheet stored in the sheet storage is not in contact with the pick roller, the hardware processor moves the holding member toward the pick roller until a sheet can be delivered by the pick roller, and the hardware processor drives the drive source during a period from when it is determined that a sheet stored in the sheet storage cannot be delivered to when the movement of the holding member ends, and wherein the hardware processor calculates a movement time required from the start of the movement of the holding member to a state where the pick roller can deliver a sheet, and the hardware processor, when driving the drive source for cleaning the paper feed roller, stops the drive source before the movement time elapses after starting the movement of the holding member.

17. A control method of a paper feeder, the paper feeder comprising:

a sheet storage that stores sheets;

a pick roller that delivers sheets stored in the sheet storage to a downstream side of a conveyance path;

a pair of conveyance rollers that is located on a downstream side of the pick roller in the conveyance path and conveys a sheet delivered from the pick roller to further a downstream side in the conveyance path; and a drive source that drives the pick roller and the pair of conveyance rollers, wherein the number of sheets fed by the pair of conveyance rollers is counted, a cleaning time is determined in accordance with the number of fed sheets, the cleaning time being a time period during which the drive source is driven for cleaning the pair of conveyance rollers, and the pair of conveyance rollers is cleaned by driving the drive source to rotate the pair of conveyance rollers in a state of being in contact with each other until a drive time of the drive source reaches the cleaning time, while the pick roller is in contact with the sheets and the power transmitter disables power transmission from the drive source to the pick roller.

* * * * *